US005674328A

United States Patent [19]

Mannava et al.

[11] Patent Number: 5,674,328

[45] Date of Patent: Oct. 7, 1997

[54] DRY TAPE COVERED LASER SHOCK PEENING

[75] Inventors: Seetharamaiah Mannava; Robert L. Yeaton; Albert E. McDaniel, all of Cincinnati, Ohio

[73] Assignee: General Electric Company, Cincinnati, Ohio

[21] Appl. No.: 638,622

[22] Filed: Apr. 26, 1996

[51] Int. Cl.[6] ..... C21D 1/09

[52] U.S. Cl. ..... 148/525; 148/565; 148/903; 219/121.8; 219/121.85; 427/596; 427/444; 156/275.7

[58] Field of Search ..... 148/525, 565, 148/903; 156/275.7; 219/121.6, 121.65, 121.76, 121.8, 121.66, 121.85; 427/554, 596, 444

[56] References Cited

U.S. PATENT DOCUMENTS

| | | | |
|---|---|---|---|
| 3,566,662 | 3/1971 | Champoux | 72/370 |
| 3,850,698 | 11/1974 | Mallozzi et al. | 148/515 |
| 4,002,403 | 1/1977 | Mallozzi et al. | 359/297 |
| 4,060,769 | 11/1977 | Mallozzi et al. | 359/337 |
| 4,401,477 | 8/1983 | Clauer et al. | 148/525 |
| 4,426,867 | 1/1984 | Neal et al. | 72/53 |
| 4,454,740 | 6/1984 | Neal et al. . | |
| 4,557,033 | 12/1985 | Champoux | 29/525 |
| 4,861,407 | 8/1989 | Volkmann et al. | 156/272.8 |
| 4,934,170 | 6/1990 | Easterbrook et al. | 72/370 |
| 4,937,421 | 6/1990 | Ortiz, Jr. et al. | 219/121.68 |
| 5,127,019 | 6/1992 | Epstein et al. | 372/108 |
| 5,131,957 | 7/1992 | Epstein et al. | 148/565 |
| 5,306,360 | 4/1994 | Bharti et al. | 148/525 |
| 5,409,415 | 4/1995 | Kawanami et al. | 451/39 |
| 5,571,575 | 11/1996 | Takayanagi | 427/9 |

OTHER PUBLICATIONS

"Laser shocking extends fatigue life", American Machinist, A Penton Publication, Jul. 1992, pp. 62–64.

"Laser Shock Processing Increases the Fatigue Life of Metal Parts", Materials and Processing Report, Sep. 1991, pp. 3–5.

*Primary Examiner*—Sikyin Ip

*Attorney, Agent, or Firm*—Andrew C. Hess; Nathan D. Herkamp

[57] ABSTRACT

A method of laser shock peening a metallic part by firing a laser on a laser shock peening surface of the part which has been adhesively covered by tape having an ablative medium, preferably, a self adhering tape with an adhesive layer on one side of an ablative layer and a confinement medium without flowing a confinement curtain of fluid over the surface upon which the laser beam is firing. Continuous movement is provided between the part and the laser beam while continuously firing the laser beam, which repeatably pulses between relatively constant periods, on a laser shock peening surface of the part. Using a laser beam with sufficient power to vaporize the ablative medium so that the pulses form laser beam spots on the surface and a region having deep compressive residual stresses imparted by the laser shock peening process extending into the part from the surface. The confinement medium may be supplied by a single layer of tape having a clear layer over the ablative layer or a thicker lap or thickness of laps of a tape with just an ablative layer wherein the extra thickness provides the confinement medium.

17 Claims, 5 Drawing Sheets

DRY TAPE COVERED LASER SHOCK PEENING

The Government has rights to this invention pursuant to Contract Nos. F33657-93-C-0045, F33657-86-C-2040 and F09604-95-C-0076 awarded by the Department of the Air Force.

RELATED PATENT APPLICATIONS

The present Application deals with related subject matter in copending U.S. Pat. application Ser. Nos. 08/638,623 entitled "ADHESIVE TAPE COVERED LASER SHOCK PEENING"; 08/319,346, entitled "LASER SHOCK PEENED ROTOR COMPONENTS FOR TURBOMACHINERY", 08/373,133, entitled "LASER SHOCK PEENED GAS TURBINE ENGINE FAN BLADE EDGES", U.S. Pat. application Ser. Nos. 08/399,285, "LASER SHOCK PEENED GAS TURBINE ENGINE COMPRESSOR BLADE EDGES" and 08/362,362, entitled "ON THE FLY LASER SHOCK PEENING".

BACKGROUND OF THE INVENTION

1. Field of the Invention

This invention relates to laser shock peening of gas turbine engine parts and, more particularly, to adhesively covering laser shock peening surfaces of a workpiece with tape which includes an ablative medium and a confinement medium for producing localized compressive residual stresses imparted in the workpiece by laser shock peening without using a fluid flow confinement curtain.

2. Description of Related Art

Laser shock peening or laser shock processing, as it also referred to, is a process for producing a region of deep compressive residual stresses imparted by laser shock peening a surface area of a workpiece. Laser shock peening typically uses multiple radiation pulses from high power pulsed lasers to produce shock waves on the surface of a workpiece similar to methods disclosed in U.S. Pat. No. 3,850,698, entitled "Altering Material Properties"; U.S. Pat. No. 4,401,477, entitled "Laser Shock Processing"; and U.S. Pat. No. 5,131,957, entitled "Material Properties". Laser peening, as understood in the art and as used herein, means utilizing a laser beam from a laser beam source to produce a strong localized compressive force on a portion of a surface by producing an explosive force by instantaneous ablation or vaporization of a painted or coated or uncoated surface. Laser peening has been utilized to create a compressively stressed protection layer at the outer surface of a workpiece which is known to considerably increase the resistance of the workpiece to fatigue failure as disclosed in U.S. Pat. No. 4,937,421, entitled "Laser Peening System and Method". These methods typically employ a curtain of water flowed over the workpiece. The curtain of water provides a confining medium to confine and redirect the process generated shock waves into the bulk of the material of a component being LSP'D to create the beneficial compressive residual stresses. This confining medium also serves as a carrier to remove process generated debris and any unused laser beam energy. Water is an ideal confining medium since it is transparent to the ND:YAG beam wavelength and is easy to implement in production. It was found useful to keep the water curtain in continuous contact with an essentially zero gap between the surface of the workpiece that provides the ablative medium on the part being LSP'D and the water. The water curtain often must be kept at a depth greater than 1 mm. Many surface tension effects and part geometry make it difficult to maintain an essentially zero gap and the desired depth resulting in the loss of the expected LSP effect. The invention of U.S. patent application Ser. No. 08/511,771 entitled "METHOD AND APPARATUS FOR LASER SHOCK PEENING" discloses means to provide enhanced water confinement and water curtain properties.

Laser shock peening is a process that, as any production technique, involves machinery and is time consuming and expensive. Therefore, any techniques that can reduce the amount or complexity of production machinery and/or production time are highly desirable. The invention disclosed in the 08/638,623 patent application is directed at replacing the time consuming painting and paint drying steps with a less time consuming taping step and incorporating a clear fluid flow curtain, water being the preferred medium, which provides confinement of the explosive force generated by the instantaneous ablation or vaporization of the taped surface. The present invention is directed at replacing the time consuming painting step with a less time consuming taping step and eliminating the need to provide a clear fluid flow or water curtain during the laser shock peening process.

The region of deep compressive residual stresses imparted by laser shock peening of the present invention is not to be confused with a surface layer zone of a workpiece that contains locally bounded compressive residual stresses that are induced by a hardening operation using a laser beam to locally heat and thereby harden the workpiece such as that which is disclosed in U.S. Pat. No. 5,235,838, entitled "Method And Apparatus For Truing Or Straightening Out Of True Work Pieces". The present invention uses multiple radiation pulses from high power pulsed lasers to produce shock waves on the surface of a workpiece similar to methods disclosed in U.S. Pat. No. 3,850,698, entitled "Altering Material Properties"; U.S. Pat. No. 4,401,477, entitled "Laser Shock Processing"; and U.S. Pat. No. 5,131,957, entitled "Material Properties". Laser peening, as understood in the art and as used herein, means utilizing a laser beam from a laser beam source to produce a strong localized compressive force on a portion of a surface. Laser peening has been utilized to create a compressively stressed protection layer at the outer surface of a workpiece which is known to considerably increase the resistance of the workpiece to fatigue failure as disclosed in U.S. Pat. No. 4,937,421, entitled "Laser Peening System and Method". One issue is manufacturing costs of the laser shock peening process which can be prohibitively expensive. The laser shock peening process of the present invention is designed to provide cost saving methods for laser shock peening by eliminating the expensive and time consuming of painting and drying an ablative coating on the laser shock peening surface and eliminating the machinery and materials for flowing a curtain of water or other confinement medium over the surface while laser shock peening.

SUMMARY OF THE INVENTION

A method of laser shock peening a metallic part by firing a laser on a dry laser shock peening taped surface of the part which has been adhesively covered by tape having an ablative medium and a confinement medium, preferably a self adhering tape with an adhesive layer on one side of an ablative layer. The laser beam is fired dry, meaning without flowing a curtain of water or other fluid over the surface upon which the laser beam is firing. One particular method includes continuously moving the part, while continuously firing a stationary laser beam, which repeatably pulses between relatively constant periods, on a portion of the part. Using a laser beam with sufficient power to vaporize the ablative medium, the pulses forming laser beam spots formed by the laser beam on the surface and forming a region having deep compressive residual stresses imparted by the laser shock peening process extending into the part from the laser shock peened surface. The part may be moved linearly to produce at least one row of overlapping circular laser beam spots having generally equally spaced apart linearly aligned center points and the part may be moved and the laser beam fired to produce more than one row of overlapping circular laser beam spots having generally equally spaced apart linearly aligned center points wherein adjacent rows of spots overlap. The laser beam may be fired and the part moved so that the center points of adjacent spots in adjacent rows are also offset from each other a generally equal amount in a direction along a line on which the center points are linearly aligned. These steps may be repeated using fresh tape on each sequence of laser firings.

The taping may be with a single layer of adhesive tape having an adhesive layer on one side of an ablative layer containing the ablative medium and a confinement layer having the confinement medium, preferably a clear plastic medium, on an opposite side of the ablative layer. More than one layer may be used. A thicker tape layer may also be used having one or more layers of an adhesive plastic tape with an adhesive layer on one side of an ablative layer containing the ablative medium and which also serves as the confinement medium.

In another embodiment of the present invention, the laser shock peened taped surface is laser shock peened using a set of sequences, in which each sequence of the surface is taped and, then, the part is continuously moved while continuously firing a stationary laser beam on the surface, such that adjacent laser shock peened circular spots are hit in different ones of the sequences in the set so that no laser spots overlap in any one sequence. In a more particular embodiment, the laser beam is fired and the part moved so that the center points of adjacent spots in adjacent rows are offset from each other a generally equal amount in a direction along a line on which the center points are linearly aligned.

ADVANTAGES

Advantages of the present invention are numerous and include lowering the cost, time, man power and complexity of laser shock peening. The present invention replaces the tedious, costly and time consuming painting, re-painting and paint drying steps with a less time consuming taping step as well as eliminating the need for a flow of confining fluid, typically water. It also eliminates the machinery and materials involved in painting and drying and flowing a fluid confinement flow over the laser shock peening surface. It also makes the process faster by eliminating the paint drying steps.

Among the advantages provided by the present invention is a cost efficient method to laser shock peen surfaces of portions of gas turbine engine parts, such as blades, designed to operate in high tensile and vibratory stress fields which can better withstand fatigue failure due to nicks and tears in the leading and trailing edges of the fan blade and have an increased life over conventionally constructed fan blades. Another advantage of the present invention is that fan and compressor blades and other parts can be constructed with cost efficient methods to provide commercially acceptable life spans without increasing thicknesses along the leading and trailing edges as is conventionally done. The present invention can be advantageously used to refurbish existing fan and compressor blades with a low cost method for providing safe and reliable operation of older gas turbine engine fan blades while avoiding expensive redesign efforts or frequent replacement of suspect fan blades as is now often done or required.

BRIEF DESCRIPTION OF THE DRAWINGS

The foregoing aspects and other features of the invention are explained in the following description, taken in connection with the accompanying drawings where.

DETAILED DESCRIPTION OF THE INVENTION

Figure 1:
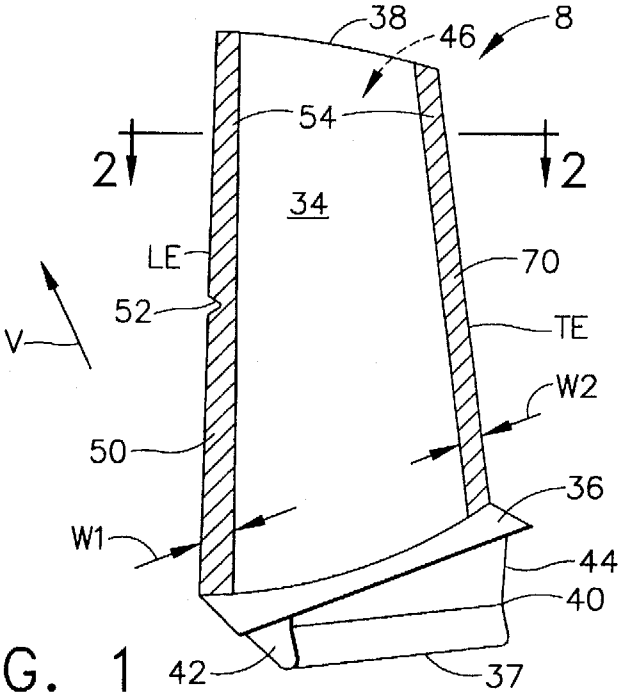
FIG. 1 is a perspective view of a fan blade to be processed in accordance with an exemplary embodiment of the method of the present invention.
Figure 2:
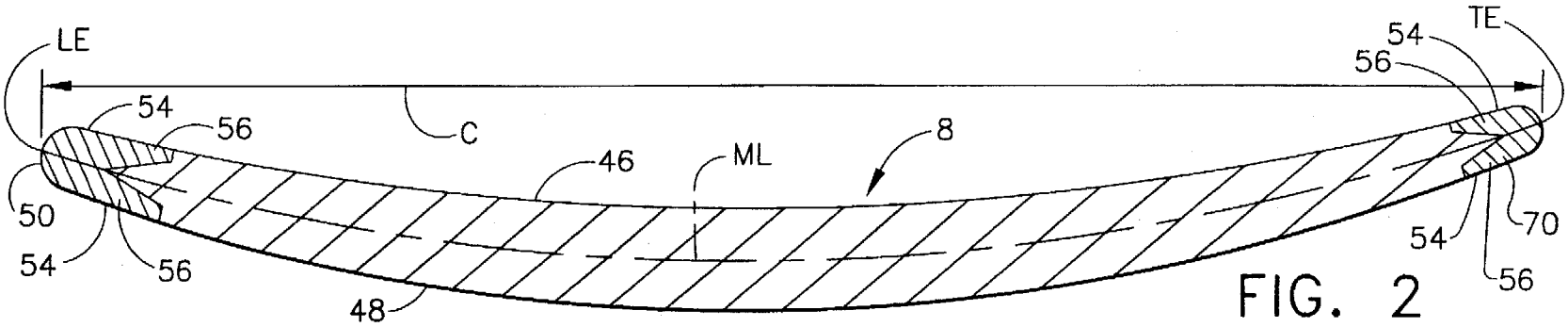
FIG. 2 is a cross-sectional view of the processed fan blade in FIG. 1.

Illustrated in FIGS. 1 and 2 is a schematic representation of an exemplary aircraft turbofan gas turbine engine fan blade 8 for laser shock peening in accordance with one embodiment of the present invention. The fan blade 8 includes an airfoil 34 extending radially outward from a blade platform 36 to a blade tip 38. The fan blade 8 includes a root section 40 extending radially inward from the platform 36 to a radially inward end 37 of the root section 40. At the radially inward end 37 of the root section 40 is a blade root 42 which is connected to the platform 36 by a blade shank 44. The airfoil 34 extends in the chordwise direction between a leading edge LE and a trailing edge TE of the airfoil. A chord C of the airfoil 34 is the line between the leading edge LE and trailing edge TE at each cross-section of the blade as illustrated in FIG. 2. A pressure side 46 of the airfoil 34 faces in the general direction of rotation as indicated by an arrow V and a suction side 48 is on the other side of the airfoil and a mean-line ML is generally disposed midway between the two faces in the chordwise direction.

The fan blade 8 has a leading edge section 50 that extends along the leading edge LE of the airfoil 34 from the blade platform 36 to the blade tip 38. The leading edge section 50 includes a predetermined first width W1 such that the leading edge section 50 encompasses nicks 52 and tears that may occur along the leading edge of the airfoil 34. The airfoil 34 subject to a significant tensile stress field due to centrifugal forces generated by the fan blade 8 rotating during engine operation. The airfoil 34 is also subject to vibrations generated during engine operation and the nicks 52 and tears operate as high cycle fatigue stress risers producing additional stress concentrations around them.

To counter fatigue failure of portions of the blade along possible crack lines that can develop and emanate from the nicks and tears at least one and preferably both of the pressure side 46 and the suction side 48 have a laser shock peening surfaces 54 and a pre-stressed region 56 having deep compressive residual stresses imparted by laser shock peening (LSP) extending into the airfoil 34 from the laser shock peened surfaces as seen in FIG. 2. Preferably, the pre-stressed regions 56 are co-extensive with the leading edge section 50 in the chordwise direction to the full extent of width W1 and are deep enough into the airfoil 34 to coalesce for at least a part of the width W1. The pre-stressed regions 56 are shown co-extensive with the leading edge section 50 in the radial direction along the leading edge LE but may be shorter.

Figure 3B:
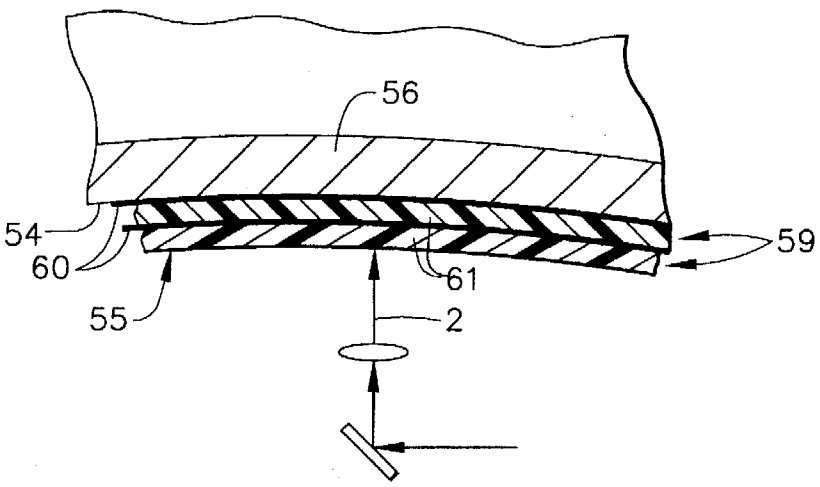
FIG. 3B is a cross-sectional view of an alternative method of taping the blade edges in FIG. 3A.
Figure 3:
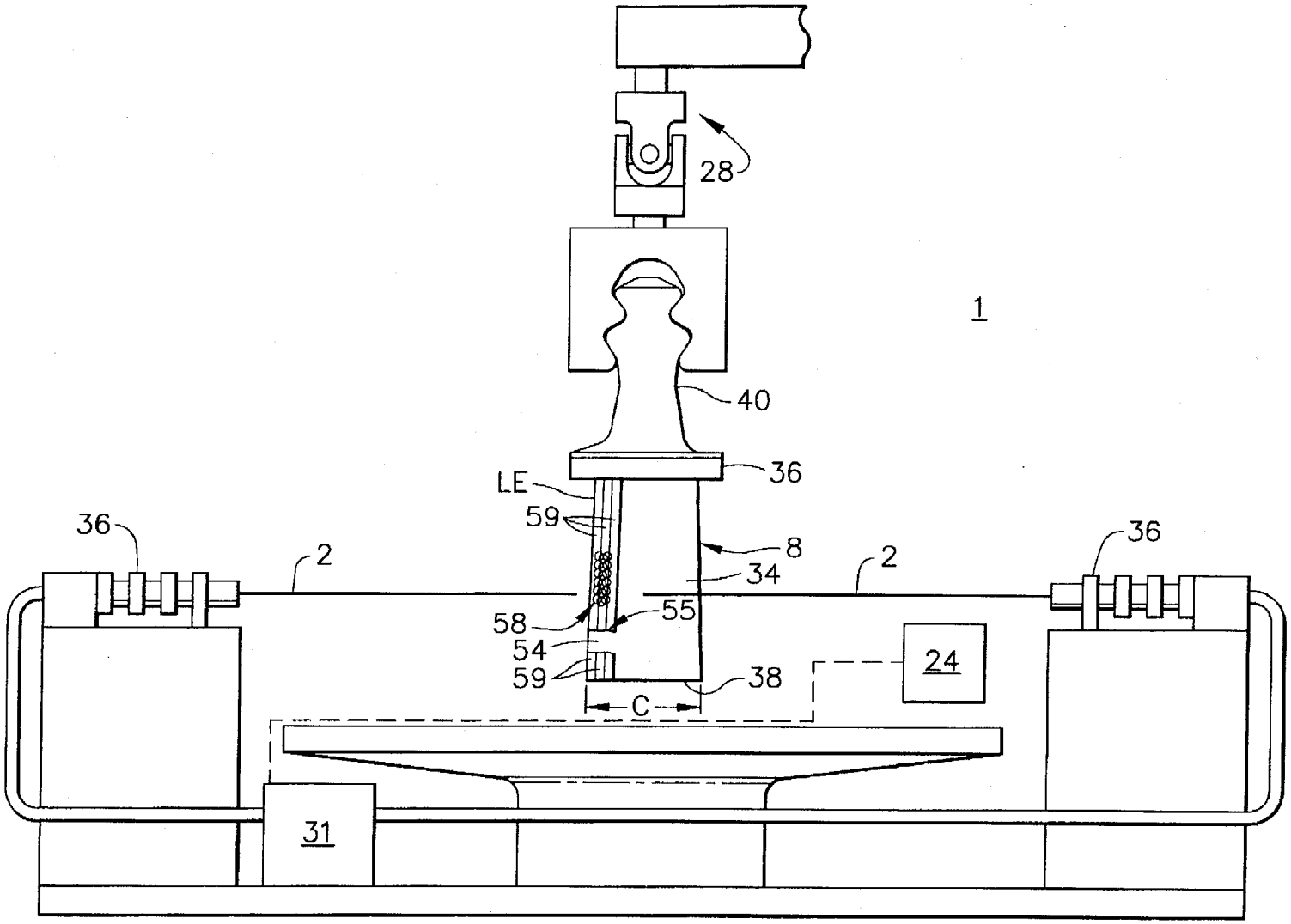
FIG. 3 is a schematical perspective view of the blade of FIG. 1 taped and mounted in a laser shock peening system illustrating the method of the present invention.
Figure 3A:
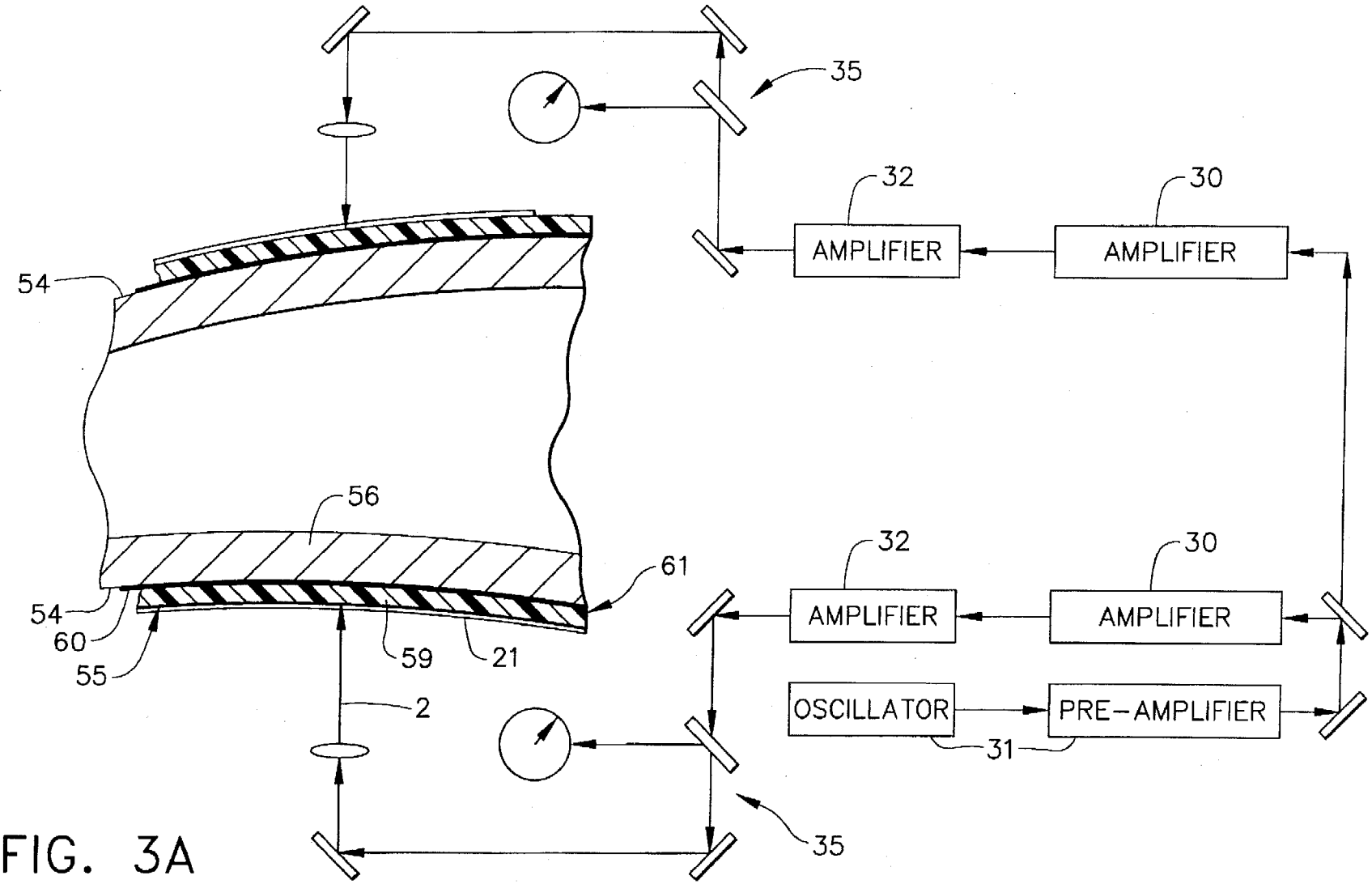
FIG. 3A is a partial cross-sectional and a partial schematic view of the setup in FIG. 3.

Illustrated in FIGS. 3 and 3A is the blade 8 mounted in a robotic arm 28 used to move and position the blade to effect laser shock peening "on the fly" in accordance with a laser shock peening method and apparatus 1 of the present invention. The invention is illustrated for use in laser shock peening the leading edge section 50, in accordance with an embodiment of the present invention, as indicated by a laser shock peening surface 54, which is covered by a layer of an adhesive tape 59 having overlapping laser shocked peened circular spots 58. Whereas, in previous laser shock peening processes, the laser shock peening surfaces 54 would have been painted before each sequence of laser shock peening.

The exemplary tape 59 includes an ablative medium layer 61 and a confinement layer 21 and, preferably, an adhesive layer 60 as illustrated in FIG. 3A. The clear confining layer 21 replaces what has been generally used up until now, a clear fluid curtain, usually a flow of water over the laser shock peening surface 54. A form of the tape 59, without an adhesive layer, may also be used with a suitable adhesive material applied directly to the laser shock peening surface 54. Suggested materials for the ablative confinement layers include plastic, such as vinyl plastic film, wherein the ablative medium may be pigmented black and the confinement layer pigmented clear. The tape 59 should be rubbed or otherwise pressed against the shock peening surface 54 to remove bubbles that may remain between the tape and the laser shock peening surface. The tape is considered a coating of the surface 54 for the purposes of this patent. The fan blade 8 also has a trailing edge section 70 that extends along the trailing edge TE of the airfoil 34 from the blade platform 36 to the blade tip 38. The trailing edge section 70 includes a predetermined second width W2 in which it may also be desirable to form laser shock peening surfaces 54 and pre-stressed regions 56 having deep compressive residual stresses imparted by laser shock peening (LSP) extending into the airfoil 34 from the laser shock peened surfaces as seen in FIG. 2.

Alternatively, the present invention provides that laser shock peening surfaces 54 may be adhesively covered with at least one thick tape lap or two or more thinner laps of a tape 59 without the clear confinement layer 21 to provide a laser shock peening taped surface 55 as illustrated in FIG. 3B. The tape 59 should provide a good ablative medium and adhesive medium. Preferably, the tape 59 is self adhesive having an adhesive layer 60 of adhesive material and an ablative layer 61 of ablative material as illustrated in FIG. 3A. Suggested materials for the ablative layer include plastic such as vinyl plastic film. One suitable source for the tape 59 is SCOTCH BRAND NO. 471 PLASTIC FILM TAPE which can be had with a black pigmented vinyl plastic backing, about 4 mils thick, and has a rubber adhesive layer, about 1 mil thick. The ablative medium in the form of the tape 59 without an adhesive layer may also be used with a suitable adhesive material applied directly to the laser shock peening surface 54. The lap or laps of tape 59 should also be rubbed or otherwise pressed against the shock peening surface 54 to remove bubbles that may remain between the tape and the laser shock peening surface. The tape is considered a coating of the surface 54 for the purposes of this patent.

The laser shock peening apparatus 1 illustrated herein includes a laser beam apparatus including a generator 31 having an oscillator and a pre-amplifier and a beam splitter which feeds the pre-amplified laser beam into two beam optical transmission circuits each having a first and second amplifier 30 and 32, respectively, and optics 35 which include optical elements that transmit and focus the laser beam 2 on the laser shock peening taped surface 55. The controller 24 may be used to modulate and fire the laser beam apparatus to fire the laser beam 2 on the laser shock peening taped surface 55 in a controlled manner.

The laser beam shock induced deep compressive residual stresses in the compressive pre-stressed regions 56 are generally about 50–150 KPSI (Kilo Pounds per Square inch) extending from the laser shock peening surfaces 54 to a depth of about 20–50 mils into laser shock induced compressive residually stressed regions 56. The laser beam shock induced deep compressive residual stresses are produced by repetitively firing a high energy laser beam 2 that is defocused ± a few mils with respect to the laser shock peening taped surface 55. The laser beam 2 typically has a peak power density on the order of magnitude of a gigawatt/$cm^2$ and is fired without the use of a curtain of flowing water that is flowed over the taped surface 55 in the prior art. The ablative medium is ablated generating plasma which results in shock waves on the surface of the material. These shock waves are redirected towards the taped surface by the clear confinement layer 21 or alternatively by the combined thickness of the multiple tape laps in the embodiment illustrated in FIG. 3B to generate travelling shock waves (pressure waves) in the material below the taped surface. The amplitude and quantity of these shockwave determine the depth and intensity of compressive stresses. The tape is used to protect the target surface, generate plasma, and confine the explosion and direct the shockwave to the laser shock peening surface 54.

Figure 4:
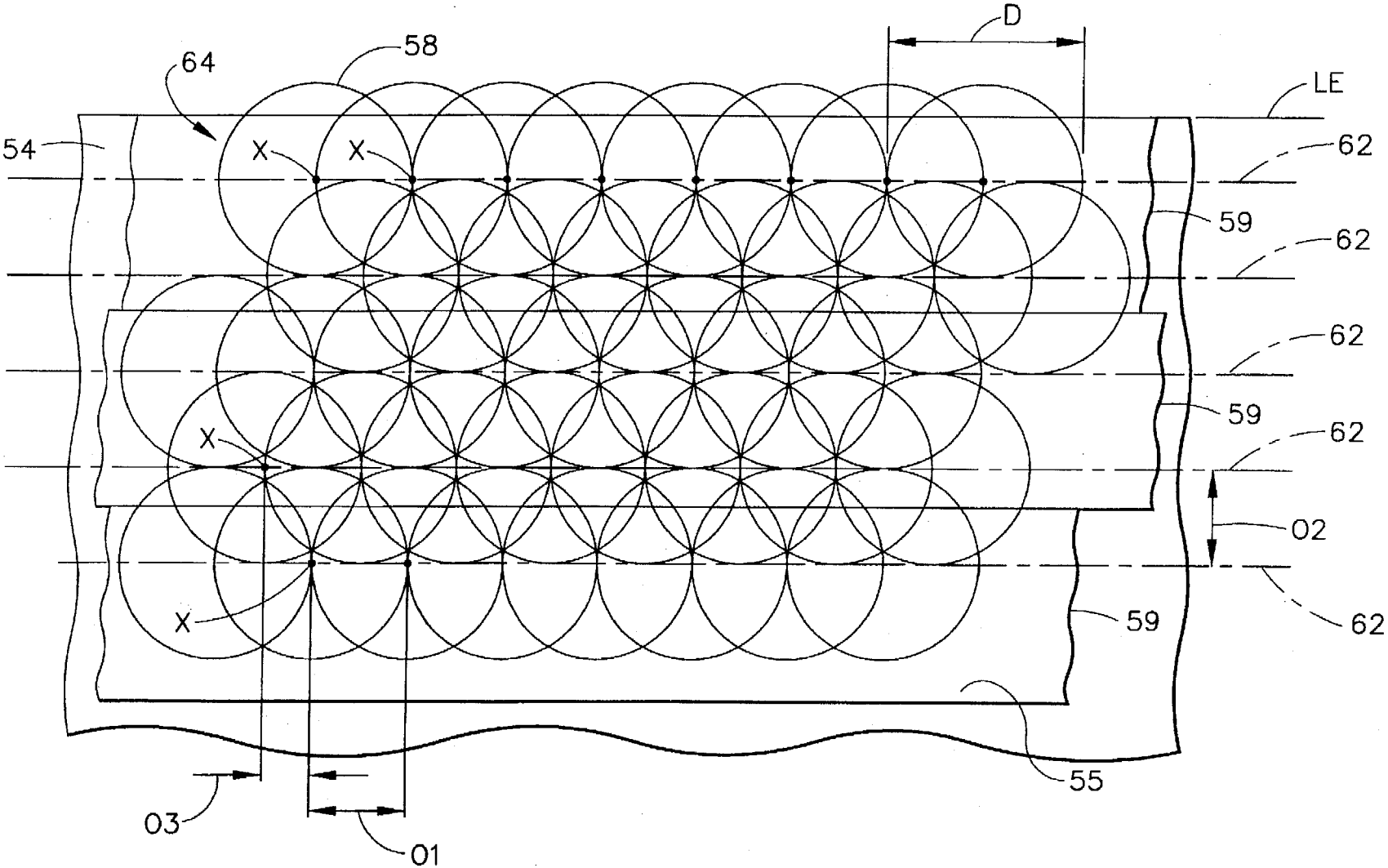
FIG. 4 is a schematic illustration of a pattern of laser shocked peened circular spots on a laser shock peened surface along a leading edge of the fan blade in FIG. 2.

The laser may be fired sequentially "on the fly", as illustrated in FIG. 4, so that the laser shock peening taped surface 55 is laser shock peened with more than one sequence of firings on the laser shock peening taped surface 55. The preferred embodiment of the method of the present invention includes continuously moving the blade while continuously firing the laser beam on the taped surface such that adjacent laser shock peened circular spots are hit in different sequences. However, the laser beam may be moved instead just so long as relative movement between the beam and the surface is effected.

Figure 5:
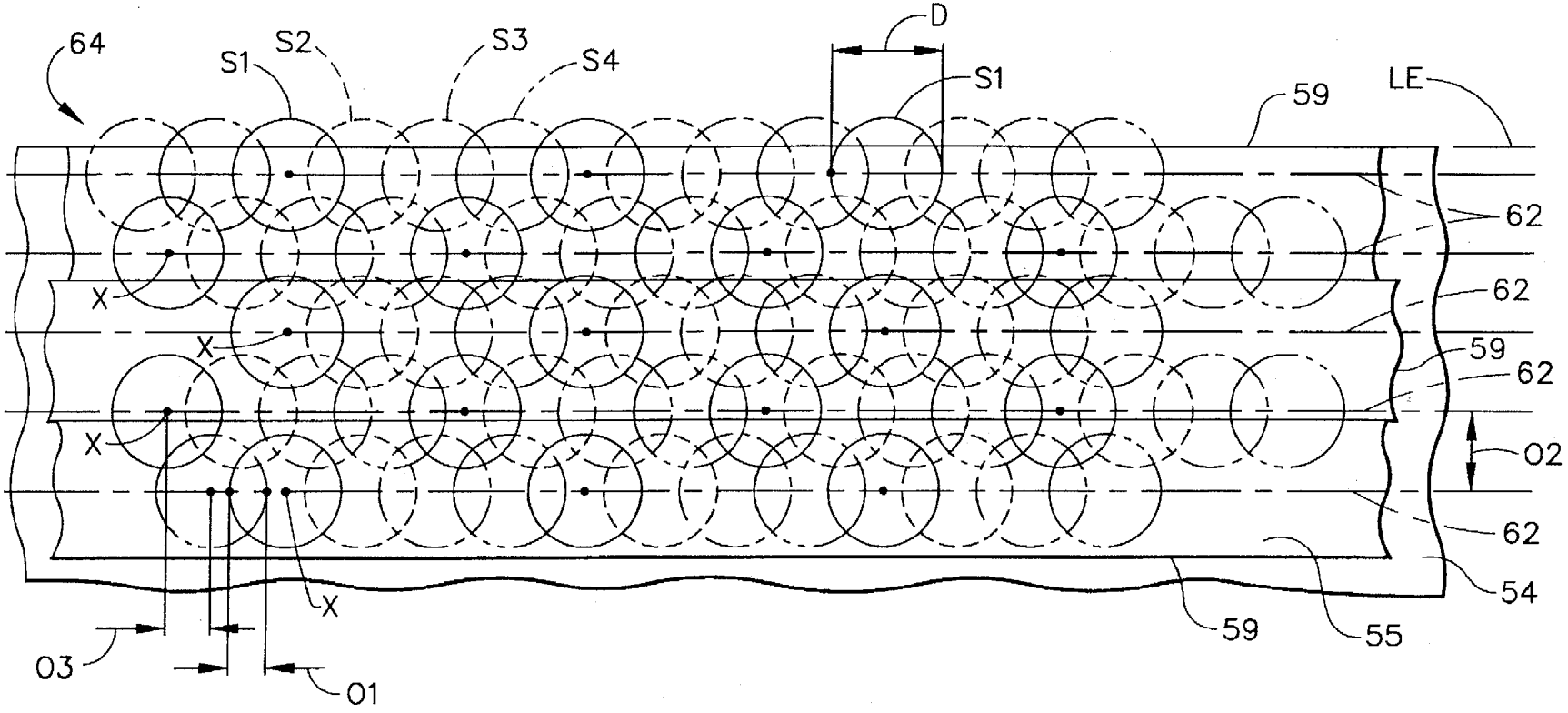
FIG. 5 is a schematic illustration of a particular pattern having four sequences of laser shocked peened circular spots that don't overlap within a given sequence.

FIGS. 4 and 5 illustrates a pattern of laser shocked peened circular spots 58 (indicated by the circles) of four such sequences S1 through S4. The S1 sequence is shown as full line circles, as opposed to dotted line circles of the other sequences, to illustrate the feature of having non adjacent laser shocked peened circular spots 58 with their corresponding centers X along a row centerline 62. The pattern of sequences entirely covers the laser shock peening taped surface 55. The laser shocked peened circular spots 58 have a diameter D in a row 64 of overlapping laser shock peened circular spots. The pattern may be of multiple overlapping rows 64 of overlapping shock peened circular spots on the laser shock peening taped surface 55. A first overlap is between adjacent laser shock peened circular spots 58 in a given row and is generally defined by a first offset 01 between centers X of the adjacent laser shock peened circular spots 58 and can vary from about 30%–50% or more of the diameter D. A second overlap is between adjacent laser shock peened circular spots 58 in adjacent rows and is generally defined by a second offset 02 between adjacent row centerlines 62 and can vary from about 30%–50% of the diameter D depending on applications and the strength or fluency of the laser beam. A third overlap in the form of a linear offset 03 between centers X of adjacent laser shock peened circular spots 58 in adjacent rows 64 and can vary from about 30%–50% of the diameter D depending on a particular application.

This method is designed so that only virgin or near virgin tape is ablated away without any appreciable effect or damage on the surface of the airfoil. This is to prevent even minor blemishes or remelt due to the laser which might otherwise cause unwanted aerodynamic effects on the blade's operation. Several sequences may be required to cover the entire pattern and re-taping of the laser shock peening surfaces 54 is done between each sequence of laser firings. The laser firing each sequence has multiple laser firings or pulses with a period between firings that is often referred to a "rep". During the rep, the part is moved so that the next pulse occurs at the location of the next laser shocked peened circular spot 58. Preferably, the part is moved continuously and timed to be at the appropriate location at the pulse or firing of the laser beam. One or more repeats of each sequence may be used to hit each laser shocked peened circular spot 58 more than once. This may also allow for less laser power to be used in each firing or laser pulse.

One example of the present invention is a fan blade 8 having an airfoil about 11 inches long, a chord C about 3.5 inches, and laser shock peening surfaces 54 about 2 inches long along the leading edge LE. The laser shock peened surfaces 54 are about 0.5 inches wide (W1). A first row 64 of laser shocked peened circular spots 58 nearest the leading edge LE extends beyond the leading edge by about 20% of the laser spot diameter D which is about 0.27", thus, imparting deep compressive residual stresses in the pre-stressed region 56 below the laser shock peening surfaces 54 which extend about 0.54 inches from the leading edge. Four sequences of continuous laser firings and blade movement are used. The firings between reps of the laser are done on spots 58 which lie on unablated taped surfaces which requires a re-tape between each of the sequences. Each spot 58 is hit three times and, therefore, three sets of four sequences are used for a total of twelve taping and re-tapings of the laser shock peening surface 54.

Illustrated in FIG. 5 is an alternative embodiment of a laser shock peening process in accordance with the present invention. The process may be used to laser shock peen the entire, or a portion of, the fan blade leading edge using five rows of laser shock peened spots and covering the entire area of the laser shock peened surfaces 54 in four sequences designated S1, S2, S3 and S4. The laser shock penning process starts with the first sequence where every four spots is laser shock peened on sequence 1 while the blade is continuously moved and the laser beam is continuously fired or pulsed. The part is timed to move between adjacent laser shock peened spots in the given sequence such as S1. The timing coincides with the rep between the pulses of the continuous laser firing on the blade. All five rows of the overlapping laser shocked peened circular spots 58 contain spots of each sequence spaced apart a distance so that other laser shock peened circular spots of the same sequence don't effect the tape around it. Sequence 1, preceded by a first taping, is shown by the complete or full circles in the FIG. 4 while the other laser shock peened spots such as in sequence S2, S3 and S4 are illustrated as dotted line, single dashed line, and double dashed line circles, respectively. Before the next sequence, such as between sequence S1 and sequence S2, the entire area of the laser shock peening surface 54 to be laser shock peened is re-taped. This procedure of re-taping avoids any of the bare metal of the laser shock peening surface from being hit directly with the laser beam. For an area coverage of five rows with the spacing between rows and between adjacent spots of about 30%, it is found that one tape and three re-tapes will be necessary so that the part is actually taped four times in total which is much faster and less consuming of manpower and machinery than the painting and re-painting steps it replaces. It has been found desirable to laser shock peen a given part, such as a fan blade, with between two and five rows. It has also been found desirable to laser shock peen each spot 58 up to 3 or more times. If each spot 58 is hit 3 times then 1 taping and 11 re-tapings is required for three sets of sequences S1–S4 for a total of 12 tapings.

While the preferred embodiment of the present invention has been described fully in order to explain its principles, it is understood that various modifications or alterations may be made to the preferred embodiment without departing from the scope of the invention as set forth in the appended claims.

We claim:

1. A method of laser shock peening a metallic workpiece, said method comprising the following steps:

forming a taped surface by adhesively covering a laser shock peening surface on the workpiece with an adhesive tape such that the tape provides a self adhesive layer, an ablative medium and a confinement medium, continuously firing a laser beam, which repeatably pulses between relatively constant periods, on the taped surface of the workpiece while providing continuous movement between the laser beam and the metallic workpiece, firing the laser beam with sufficient power to vaporize the ablative medium of the tape with the pulses and forming laser beam spots on the tape and forming a region in the workpiece having deep compressive residual stresses imparted by the laser beam pulsing such that the region extends into the workpiece from the laser shock peening surface, and firing the laser beam without flowing a fluid curtain over the tape upon which the laser beam is firing to form a pattern of overlapping laser beam spots while moving the laser relative to the workpiece.

2. A method as claimed in claim 1 further comprising simultaneously laser shock peening two sides of the workpiece using the method in claim 1.

3. A method as claimed in claim 1 wherein the workpiece is moved linearly to produce a row of overlapping circular laser beam spots having generally equally spaced apart linearly aligned center points.

4. A method as claimed in claim 1 wherein the workpiece is moved and the laser beam is fired to produce more than one row of overlapping circular laser beam spots having generally equally spaced apart linearly aligned center points wherein adjacent rows of spots overlap.

5. A method as claimed in claim 4 wherein the laser beam is fired and the workpiece moved so that the center points of adjacent spots in adjacent rows are offset from each other a generally equal amount in a direction along a line on which the center points are linearly aligned.

6. A method as claimed in claim 4 wherein the laser shock peened surface is laser shock peened using a set of sequences wherein each sequence comprises taping the surface with a tape suitable to generate and confine a plasma which results in shock waves to form the region having deep compressive residual stresses and then continuously moving the workpiece while continuously firing a stationary laser beam on the surface such that adjacent laser shock peened circular spots are hit in different ones of said sequences in said set.

7. A method as claimed in claim 6 wherein the laser beam is fired and the workpiece moved so that the center points of adjacent spots in adjacent rows are offset from each other a generally equal amount in a direction along a line on which the center points are linearly aligned.

8. A method as claimed in claim 7 further comprising a plurality of said sequence wherein essentially each spot is hit more than once in different ones of said plurality and only once in any of said sequence.

9. A method as claimed in claim 1 wherein a single layer of adhesive tape is used wherein the adhesive tape has an adhesive layer on one side of an ablative layer containing the ablative medium and a confinement layer having the confinement medium on an opposite side of the ablative layer.

10. A method as claimed in claim 9 further comprising simultaneously laser shock peening two sides of the workpiece using the method in claim 1.

11. A method as claimed in claim 9 wherein the workpiece is moved linearly to produce a row of overlapping circular laser beam spots having generally equally spaced apart linearly aligned center points.

12. A method as claimed in claim 9 wherein the workpiece is moved and the laser beam is fired to produce more than one row of overlapping circular laser beam spots having generally equally spaced apart linearly aligned center points wherein adjacent rows of spots overlap.

13. A method as claimed in claim 9 wherein the laser shock peened surface is laser shock peened using a set of sequences wherein each sequence comprises taping the surface with a tape suitable to generate and confine a plasma which results in shock waves to form the region having deep compressive residual stresses and then continuously moving the workpiece while continuously firing a stationary laser beam on the surface such that adjacent laser shock peened circular spots are hit in different ones of said sequences in said set.

14. A method as claimed in claim 13 wherein the laser beam is fired and the workpiece moved so that the center points of adjacent spots in adjacent rows are offset from each other a generally equal amount in a direction along a line on which the center points are linearly aligned.

15. A method as claimed in claim 13 further comprising a plurality of said sequence wherein essentially each spot is hit more than once in different ones of said plurality and only once in any of said sequence.

16. A method as claimed in claim 1 wherein said surface portion is covered with more than one layer of said tape.

17. A method as claimed in claim 10 wherein said tape is an adhesive plastic tape having an adhesive layer on one side of an ablative layer containing the ablative medium.

* * * * *